United States Patent [19]

van Denderen et al.

[11] 4,090,389

[45] May 23, 1978

[54] METHOD OF DRAWING A SHADOW MASK

[75] Inventors: Adrianus J. van Denderen; Marianus A. G. van de Kerkhof; Mathias A. C. Peters; Jan van der Waal, all of Eindhoven, Netherlands

[73] Assignee: U.S. Philips Corporation, New York, N.Y.

[21] Appl. No.: 697,051

[22] Filed: Jun. 17, 1976

[30] Foreign Application Priority Data

Jul. 11, 1975 Netherlands ..... 7508287

[51] Int. Cl.[2] ..... B21D 22/00

[52] U.S. Cl. ..... 72/350; 72/379; 72/DIG. 8

[58] Field of Search ..... 72/350, 379, 347, 348, 72/DIG. 8; 113/120 H

[56] References Cited

U.S. PATENT DOCUMENTS

| | | | |
|---|---|---|---|
| 2,514,005 | 7/1950 | Middleton | 72/350 X |
| 3,668,914 | 6/1972 | Vyacheslavovich et al. | 72/350 |

*Primary Examiner*—Leon Gilden
*Attorney, Agent, or Firm*—Frank R. Trifari

[57] ABSTRACT

A method of drape drawing a shadow mask from a foraminous, or apertured, metal sheet that has a greater tensile in one direction than another and has edges extending in the one direction. During the drape procedure, the edges of the sheet that extend substantially in the direction in which the sheet has the greater tensile strength are allowed to slip relative to the draw ring and the pressure. As a result of this, the sheet is prevented from tearing.

4 Claims, 14 Drawing Figures

METHOD OF DRAWING A SHADOW MASK

Figure 1:
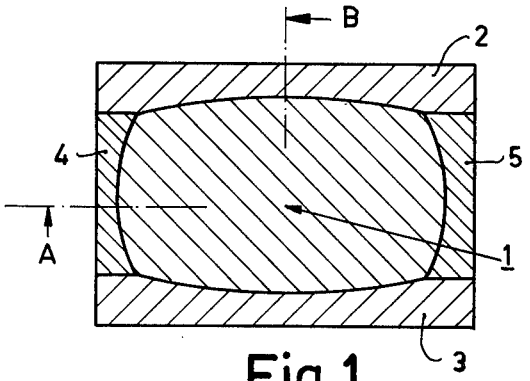

The invention relates to a method of drape drawing a shadow mask for cathode ray tube for displaying coloured pictures from a mainly rectangular metal sheet which has a large number of apertures and which during drape drawing is clamped at its edge between a draw ring and a pressure ring and is drawn over a draw die.

The invention moreover relates to a device for drape drawing shadow masks according to this method and a shadow mask drawn according to the method or by means of the device.

Such shadow masks are used in cathode ray tubes for displaying coloured pictures and are secured therein near the display screen. In addition, such a cathode ray tube comprises means for generating three electron beams which pass through the apertures in the shadow mask and impinge upon the display screen. The display screen is covered with triplets of red, green and blue luminescent regions, for example, phosphor stripes or dots. Each of the three electron beams impinges upon luminescent regions of one colour if the position of the shadow mask is determined accurately relative to the said means for generating the three electron beams and the luminescent regions. As a result of a drawing process, the shape of the shadow mask is accurately adapted to the inner surface of the display screen so that the distance between the shadow mask and the display screen throughout the surface varies in a desired manner.

Drape drawing is to be understood to mean herein the deformation in the cold state of flat metal sheets to curved parts (for example, shadow masks). The most important parts of a press suitable for said drawing process are the draw die, sometimes termed "mandril", the draw ring and the pressure ring, the latter being sometimes termed "fillet holder". During drawing, the material of the metal sheet is stretched to beyond the limit of elasticity so as to produce a permanent deformation.

A requirement for a uniform deformation is a substantially homogeneous starting material, for example, steel containing little carbon.

The pattern in which the apertures have been provided in the sheet and the shape of each aperture influence the tensile strength of the sheet in a given direction. The tensile strength (sometimes termed "ultimate strength" is by definition the tensile force at which the sheet collapses. As a result of this, during drape drawing according to the known method, cracks may be formed in the shadow mask to be formed.

The method described in the first paragraph is disclosed in U.S. Pat. Spec. No. 3,296,850 in which a metal sheet having circular apertures is drawn in all directions over the draw die by means of a draw ring and pressure ring, after which the edge of the shadow mask is bent over. This method cannot be used at all for shadow masks having, for example, rows of elongate apertures with small bridges between the apertures, since during drape drawing cracks will nevertheless occur due to the collapse of the bridges, particularly in the corners of the mainly rectangular metal sheet.

It is an object of the invention to provide a method in which said cracking substantially does not occur.

According to the invention, a method of the kind mentioned in the dirst paragraph is characterized in that during drape drawing, the parts of the edge of the sheet extending substantially in the direction in which the sheet has a greater tensile strength is allowed to slip out from between the draw ring and the pressure ring, while the parts of the edge extending substantially at right angles thereto are clamped fixedly between the draw ring and the pressure ring, after which the edge of the shadow mask is bent over.

The invention is based on the recognition of the fact that the sheet can be stretched in the direction in which it has the greatest tensile strength, while in the direction at right angles thereto a contraction occurs. The extent of the contraction depends inter alia on the size of the gap between the pressure ring and the draw ring and the resulting slip.

A device for drape drawing shadow masks according to the method of the invention is obtained in a simple manner by constructing the draw ring and/or the pressure ring in four ring parts. Each ring part is associated with a part of the edge of the sheet which lies between two corner points. With such a draw ring the gap between the pressure ring and the draw ring near the desired parts of the edge of the sheet can be obtained in a comparatively simple manner.

Figure 8:
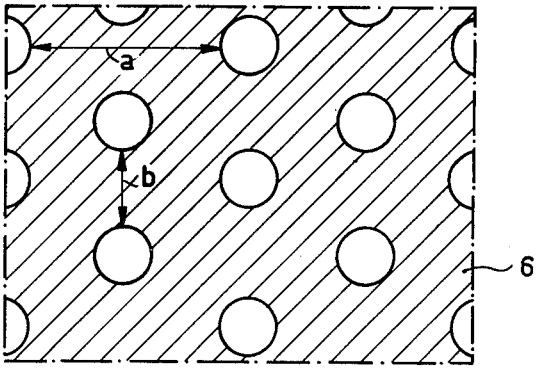
Figure 9:
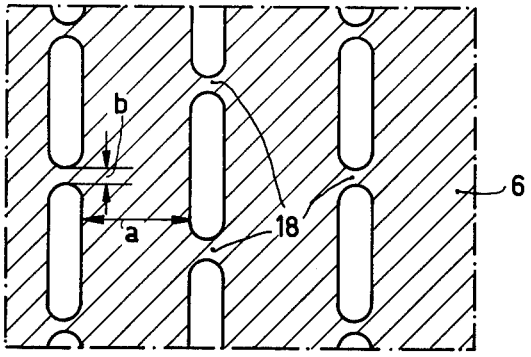

The invention will now be described in greater detail with reference to a drawing, in which FIG. 1 shows the position of the draw die and the pressure ring, FIGS. 2 to 7 show the method step by step, FIG. 8 shows an example of a part of a shadow mask having a greater tensile strength in one direction, and FIG. 9 shows an example of a part of a shadow mask having a very much greater tensile strength in one direction.

Figure 4A:
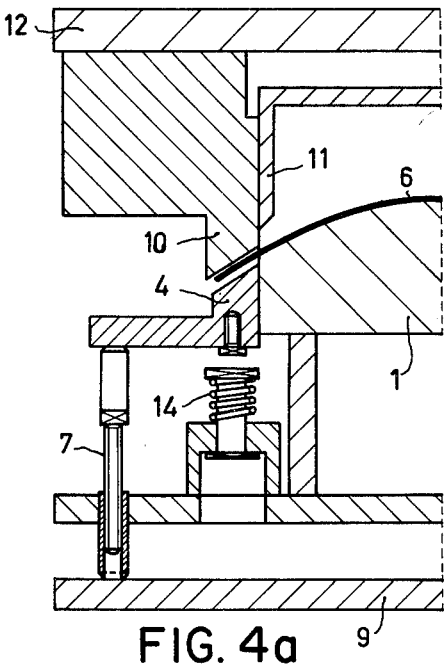
Figure 4B:
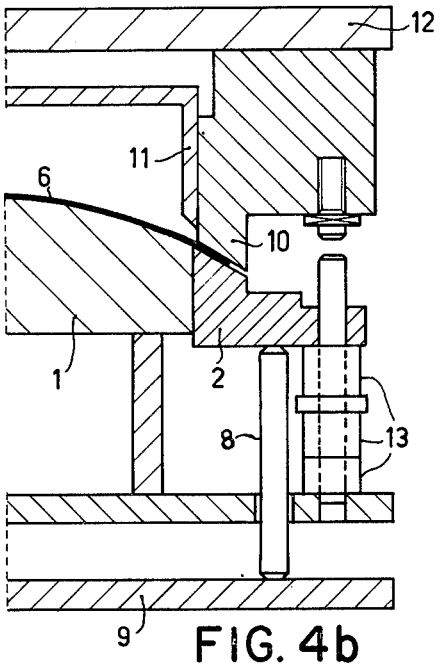
Figure 5A:
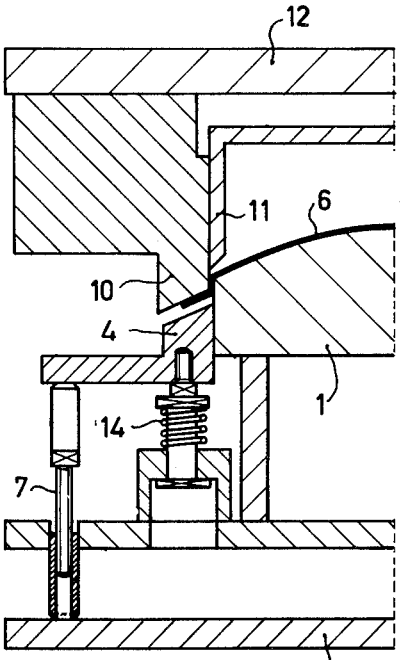

FIG. 1 shows diagrammatically the draw die 1 and the pressure ring consisting of the parts 2, 3, 4 and 5. The parts of the pressure ring engage the draw die. The metal sheet is laid on said draw die with the direction in which it has its greater tensile strength extending from part 2 to part 3 and with its edge clamped between the draw ring 10 (see FIG. 2) and parts 2 and 3 of the pressure ring. During drape drawing, the parts 4 and 5 of the pressure ring are spaced from the draw ring by a distance which is larger than the thickness of the metal sheet, as shown in FIG. 4*a*. The draw ring has the same shape as the pressure ring on its side facing the draw die. However, the draw ring does not engage the draw die, which is shown in FIG. 5, so as to leave space for the sheet 6 to be shaped into a shadow mask. In the following FIGS. 2 to 7 the method is explained by means of the series of partial sectional views A (left) and B (right) (see FIG. 1) in which the principal parts of the draw press which directly relate to the drawing process are also shown. It will be obvious that the parts 3 and 5 not shown in FIGS. 2 to 7 move in the same manner as the respective corresponding parts 2 and 4 which are shown.

Figures 2A, 2B:
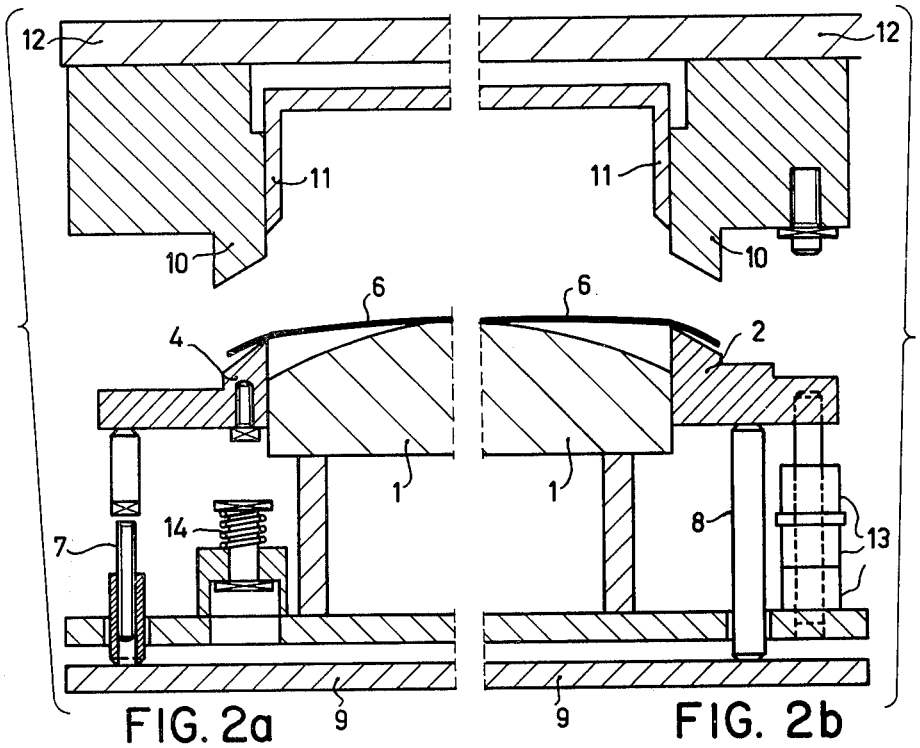

As is shown in FIG. 2, the part 2 of the pressure ring is located at a height above the draw die 1 such that the metal sheet 6 lies substantially flat on the pressure ring and the draw die. By means of the adjusting pin 7 part 4 of the pressure ring is supported at the desired distance (for example 0.1 mm) below part 2. Therefore, the adjusting pin 7 and supporting pin 8 bear on the common supporting plate 9.

Figures 3A, 3B:
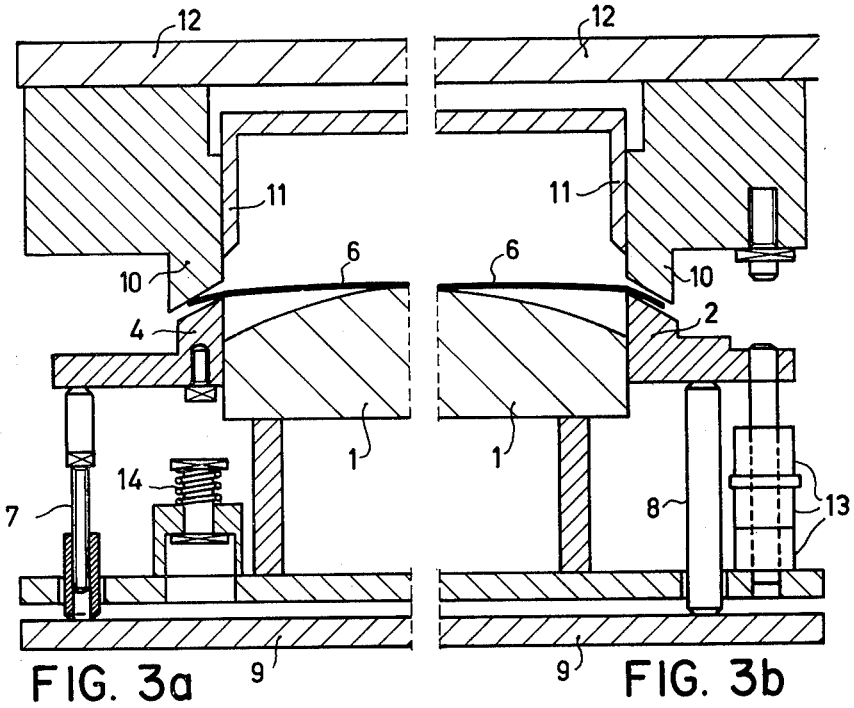

FIG. 3 shows that when the draw ring 10 and part 2 of the pressure ring clamp sheet 6 (FIG. 3*b*), there is a gap between the draw ring 10 and the part 4 of the pressure ring (FIG. 3*a*).

Figure 5B:
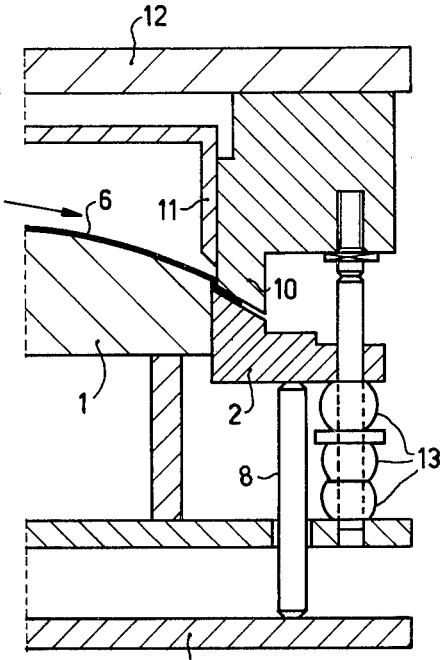
Figures 6A, 6B:
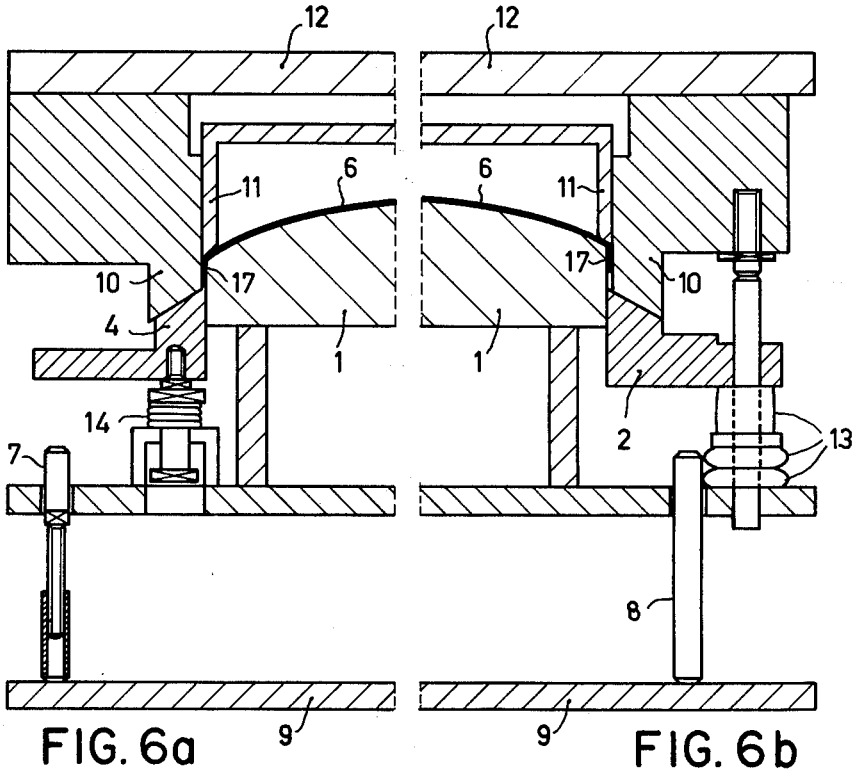
Figure 7:
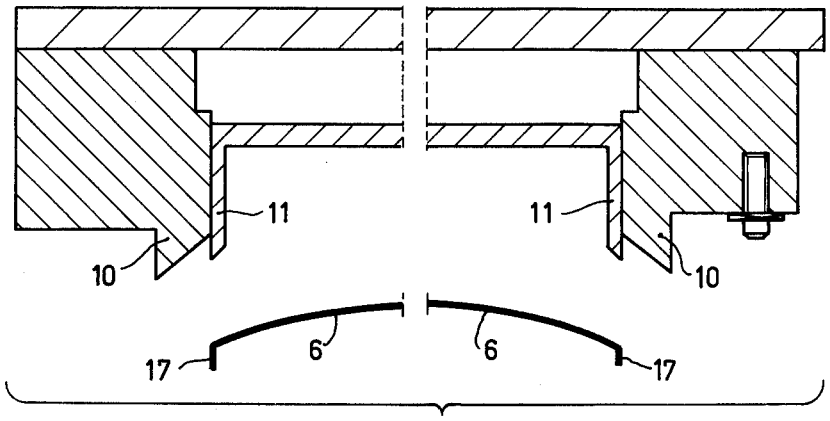

Drawing begins as soon as the sheet 6 is clamped and both the draw ring and the pressure ring are moved downwards. In FIG. 4, part 2 of the pressure ring is somewhat lower than the edge of the draw die 1 and part 4 is slightly lower still, for example, by 0.1 mm. During drawing (FIG. 5) the mask 6 is stretched in the direction of the arrow shown in FIG. 5*b* while in the direction at right angles thereto a contraction occurs. The extent of the contraction depends inter alia on the size of the adjusted gap between the draw ring 10 and the part 4 of the pressure ring, with which gap the slip resistance is adjusted. After the drawing, part 2 of the pressure ring bears on the rubber parts 13 and part 4 of the pressure ring bears on resilient members 14, after which the draw ring forces part 2 of the pressure ring against the pressure of the rubber parts 13 and part 4 of the pressure ring against the pressure of the resilient members 14. As a result of this comparatively small pressure the shadow mask is not clamped so that it slips from between the pressure ring and the draw ring and the edge 17 of this is bent over (FIGS. 5 and 6). During this bending-over the edge of the shadow mask is pressed against the draw die 1 by the ejector 11 so as to avoid unevenesses. The ejector 11 comprises a rubber layer so as not to damage the surface of the shadow mask 6 and to smooth small unevenesses. After bending the edge of the shadow mask, the ejector 11 moves away from the mask (FIG. 7) and the draw ring takes along the shadow mask 6 after which it is ejected by the ejector 11.

The method can also be performed with a device similar to that described with reference to the Figures but in which both the draw ring and the pressure ring consist of four parts. The upper side of part 4 of the pressure ring remains located in the elongation of the upper side of the draw die 1 during the actual drawing process (FIG. 5). The part of the draw ring (which now consists of four ring parts) above this leaves a gap larger than the thickness of the material of the sheet 6 open so as to permit the slipping of the sheet during drawing.

The movement of the draw ring and pressure ring can be carried out hydraulically, but, naturally, the invention is not restricted to this. The operating members required are not shown in the figures since they do not relate directly to the invention.

FIG. 8 shows a part of a shadow mask 6 having circular apertures. The distance between two circular apertures in one direction is *a* and in the direction at right angles thereto is *b*. The distance *b* is much smaller than the distance *a*, so that the tensile strength in the direction of the arrow *b* is greater due to the smaller number of apertures and the greater amount of material on a line perpendicular to this arrow. So it is preferable to draw in the direction of the arrow *b*, as a result of which the possibility of collapsing is considerably reduced.

FIG. 9 shows a part of a shadow mask in which the tensile strength in the direction of the arrow *b* is very much greater. The bridges 18 are very weak and rapidly collapse during drape drawing when the method and the device according to the invention are not used. Drawing is performed only in the direction of the arrow *b*.

The inventive idea underlying the invention is that, during the drape drawing of shadow masks, the sheet is to be drawn only in the direction having the greatest tensile strength. In the direction at right angles thereto the sheet is given the opportunity of slipping out from between the draw ring and the pressure ring.

What is claimed is:

1. A method of drape drawing a shadow mask for a color cathode ray tube from a metal sheet which has a large number of apertures and a greater tensile strength in one direction than another, said method comprising the steps of: clamping edge portions of said sheet; drawing the central portion of said sheet over a draw die; and allowing selected edge portions that extend substantially in said one direction to slip in said other direction in response to tensile force exerted on said sheet by said drawing while holding other selected edge portions that extend in said other direction fixedly clamped; and subsequently bending the edge portions over to form an edge of said mask.

2. A method according to claim 1 in which said drawing is completed by deforming the central portion of said sheet in contact with the surface of said draw die, and said other direction is perpendicular to said one direction.

3. A method according to claim 1 in which said central portion of said sheet has a generally rectangular outline with two short sides extending in said one direction and two long sides that extend in said other direction, said apertures being arranged so that the tensile strength of said sheet is greater in the direction parallel to said short sides than in the direction parallel to said long sides, and said edge portions that are allowed to slip are said short sides, said step of drawing said sheet causing deformation of the central portion of said sheet convexly with respect both to said long sides and said short sides.

4. A method according to claim 3 in which said apertures are alongated substantially parallel to said short sides, and are oriented end to end in rows and have relatively narrow bridges between proximal ends as compared with the portions of said sheet between adjacent rows of said apertures, said drawing being only in the direction of said rows.

* * * * *